US007619369B2

(12) United States Patent
Pekarski et al.

(10) Patent No.: US 7,619,369 B2
(45) Date of Patent: Nov. 17, 2009

(54) METHOD AND CIRCUIT ARRANGEMENT FOR OPERATING A DISCHARGE LAMP

(75) Inventors: Pavel Pekarski, Aachen (DE); Jan Alfons Julia Stoffels, Turnhout (BE); Holger Moench, Vaals (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 415 days.

(21) Appl. No.: 10/596,474

(22) PCT Filed: Dec. 16, 2004

(86) PCT No.: PCT/IB2004/052833

§ 371 (c)(1),
(2), (4) Date: Jun. 14, 2006

(87) PCT Pub. No.: WO2005/062684

PCT Pub. Date: Jul. 7, 2005

(65) Prior Publication Data

US 2007/0194723 A1 Aug. 23, 2007

(30) Foreign Application Priority Data

Dec. 19, 2003 (EP) ..... 03104847

(51) Int. Cl.
*H05B 37/02* (2006.01)

(52) U.S. Cl. ..... 315/291; 315/59; 315/225; 315/307

(58) Field of Classification Search ..... 315/224–225, 315/291, 307–308, DIG. 5, DIG. 7, 55–59, 315/209 R
See application file for complete search history.

(56) References Cited

U.S. PATENT DOCUMENTS

| | | | | |
|---|---|---|---|---|
| 5,677,602 | A * | 10/1997 | Paul et al. | 315/224 |
| 6,400,095 | B1 * | 6/2002 | Primisser et al. | 315/224 |
| 6,437,520 | B1 * | 8/2002 | Grouev et al. | 315/291 |
| 2002/0047645 | A1 * | 4/2002 | Kominami et al. | 315/308 |
| 2003/0227765 | A1 * | 12/2003 | Kubo | 362/20 |
| 2004/0183463 | A1 * | 9/2004 | Sun et al. | 315/224 |
| 2006/0049777 | A1 * | 3/2006 | Kumagai et al. | 315/224 |

* cited by examiner

*Primary Examiner*—David Hung Vu
*Assistant Examiner*—Tung X Le

(57) ABSTRACT

A method and a circuit arrangement for operating a discharge lamp, in particular during the first hours of operation after lamp manufacture, are described. The method and the circuit arrangement are provided in particular for high-pressure gas discharge lamps (HID or high intensity discharge lamps or UHP or ultra high performance lamps). Furthermore, a lighting unit with a discharge lamp and such a circuit arrangement and a projection system with a projection display and such a lighting unit are described. Switching-over between various modes of operation with different operating frequencies serves to avoid that the burning voltage of the lamp drops into a region of a minimum voltage of a lamp driver unit below which the latter can no longer drive the lamp with its rated power or a desired power.

16 Claims, 6 Drawing Sheets

METHOD AND CIRCUIT ARRANGEMENT FOR OPERATING A DISCHARGE LAMP

The invention relates to a method and a circuit arrangement for operating a discharge lamp in particular during the first hours of operation after manufacture of the lamp. The method according to the invention and the circuit arrangement according to the invention are provided here in particular for high-pressure gas discharge lamps (HID or high intensity discharge, or UHP or ultra high performance lamps). The invention further relates to a lighting unit with a discharge lamp and with such a circuit arrangement, and to a projection system comprising a projection display and such a lighting unit.

It can often be observed in discharge lamps, and in particular said high-pressure gas discharge lamps, that the burning voltage in part shows a considerable drop in particular during the first hours of operation after manufacture of the lamp, to such an extent that the specifications or limit values for the relevant lamp driver circuit are exceeded, so that the lamp can no longer be operated with its desired or rated power, and there is even a risk of complete failure of the lamp.

It is known from various publications how a change in the burning voltage of the lamp can be counteracted by means of changes in one or several operating parameters of the lamp.

Thus, for example, US 2001/0038267 describes a method of operating a HID lamp comprising specially shaped electrodes, whereby the distance between the electrode tips can be adjusted or changed through a change in the operating frequency of the lamp. According to this document, in particular, the lamp is to be operated at a first frequency below 50 Hz when reaching a first, higher burning voltage, and at a second frequency in a range between 50 and 700 Hz when reaching a second, lower burning voltage. Alternatively, it is specified that the first frequency lies at 750 Hz or above, and the second frequency in a range between 50 and 700 Hz.

Both measures, however, have their disadvantages and risks, in particular if the electrodes do not have the specific shapes described in this publication. On the one hand, a reduction of the operating frequency to below 50 Hz considerably increases the risk of arc leaps unless special countermeasures are taken (for example a lamp voltage with certain pulse shapes). On the other hand, the use of frequencies above approximately 700 Hz may have the result that multiple tips are formed at the electrodes, or that the electrodes are burned back to a considerable degree.

It is further known, for example, from EP 1 057 376 how to terminate or even reverse the growth of the electrodes by means of a changed pulse shape of the lamp current. This method has the disadvantage, however, that the arc discharge is generally only particularly stable under such operating conditions as support the electrode growth.

The invention has accordingly for its object to provide a method and a circuit arrangement for operating a discharge lamp by means of which a reduction of the burning voltage, in particular during the first hours of operation of the lamp after its manufacture as mentioned above, can be prevented at least to the extent that the specifications or limit values of a lamp driver circuit dimensioned for the subsequent normal operation are not exceeded.

Furthermore, the invention has for its object to provide a method and a circuit arrangement for operating a discharge lamp by means of which a reduction in the burning; voltage to below a given limit value can be prevented, in particular during the first hours of operation of the lamp after its manufacture as mentioned above, without detracting from the stability of the arc discharge.

Finally, a method and a circuit arrangement for operating a discharge lamp are to be provided by means of which a drop of the burning voltage to below a given limit value can be prevented, in particular during the first hours of operation of the lamp after its manufacture as mentioned above, also for discharge lamps having a wide variety of lamp and/or operating parameters such as electrode geometry, lamp construction, chemical composition and pressure of the discharge gas, temperature, etc.

According to claim 1, this object is achieved by means of a method of operating a discharge lamp, in particular during the first hours of operation after manufacture of the lamp, in a first, normal mode of operation having a first operating frequency, which is activated when the burning voltage of the lamp is higher than (or equal to) a first limit value $U_1$, that can be preset, and a second mode of operation with a second, higher operating frequency which is activated when the burning voltage of the lamp reaches (or undershoots) the first limit value $U_1$, and which is chosen such that the growth of the electrodes, and accordingly the drop in burning voltage caused in particular by the formation of thinner electrode tips, is limited.

The object is further achieved according to claim 13 by means of a circuit arrangement for implementing the method, which circuit arrangement comprises a comparator for comparing the burning voltage with at least one of the two limit values and a generator for generating the operating frequencies of the lamp current in dependence on the output signal of the comparator.

The invention is based on the recognition that said comparatively strong drop in the burning voltage, generally taking place only within the first hours of operation (approximately 1 to 1000 hours, depending on the lamp type), is caused by the fact that the electrodes have a comparatively small mutual distance during these first hours of operation, which distance has increased by burning-back after the first hours of operation so far that said voltage drops substantially take place no more, or only under special extreme conditions.

A particular advantage of the above solutions is that the lamp current may show the usual current pulses in the normal mode of operation and may have a square waveform in the first mode of operation of the lamp current, so that a high stability of the arc discharge can be safeguarded in both cases. This is of major importance in particular for HID and UHP lamps, so that the method according to the invention and the circuit arrangement according to the invention are particularly suitable for operating a HID or UHP discharge lamp designed for illuminating displays.

A further advantage is that the operational life of the discharge lamp is not or not substantially affected, because the lamp is only switched to the mode of operation raising the operating voltage when this is necessary, and otherwise can be controlled in the usual, known manner, with which the usual operational life is achieved.

Finally, the comparatively high reject rate of discharge lamps, in particular of HID and UHP lamps, during said first hours of operation can be considerably reduced with the solution according to the invention, even in cases in which the lamp is operated in a dimmed mode.

The dependent claims relate to advantageous further embodiments of the invention.

Claims 2 to 7 contain preferred ranges for the first and second modes of operation or operating frequencies as well as for the first limit value.

Claim 8 relates to a third mode of operation which is advantageous in particular in the case in which the lamp used has certain lamp and/or operating parameters which may lead to a particularly strong drop in the burning voltage.

Claims 9 to 12 contain preferred ranges for the third mode of operation or third operating frequency.

Further details, features, and advantages of the invention will become apparent from the ensuing description of preferred embodiments, which is given with reference to the drawing in which.

Figure 1:
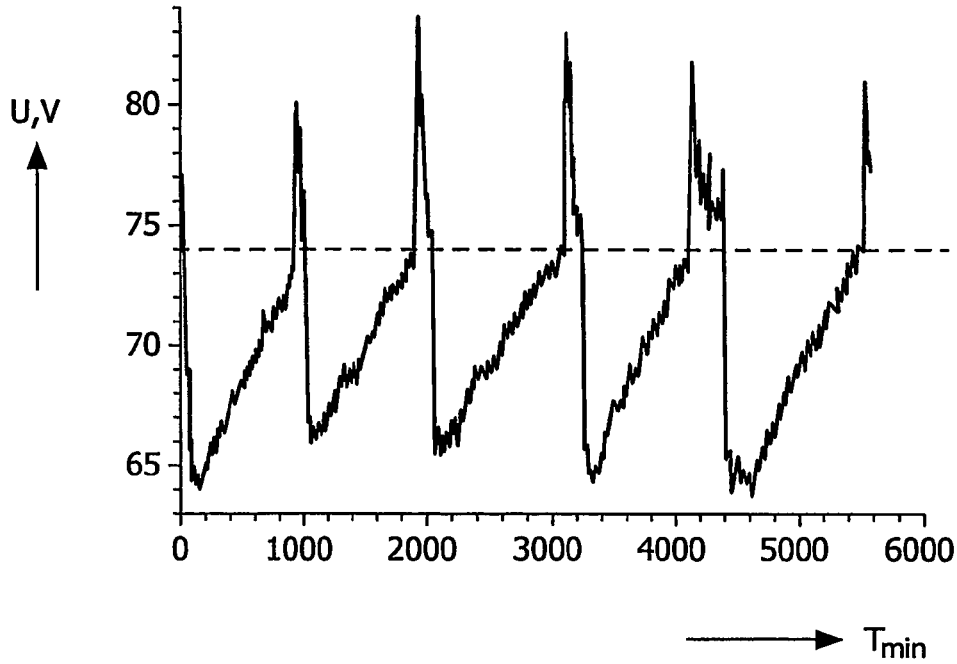
FIG. 1 shows the gradient of the burning voltage during switch-over between a first and a second mode of operation.

Various effects cause a formation of tips at the frontmost, mutually opposed surfaces of the electrodes, which tips may also be at least partly in the liquid state. Such tips do indeed have numerous advantages, because they lead inter alia to a stable arc discharge, to a reduced electrode consumption, and to a lower electrode temperature. The growth of the electrode tips, however, also has the result that the space between the electrodes, i.e. the discharge path, becomes increasingly shorter, so that the burning voltage decreases continuously to a greater or lesser degree, in particular when the electrodes still show no or only very little burning-back.

The extent of this drop depends on numerous lamp parameters such as in particular the geometry of the electrodes and of the discharge vessel, the chemical composition and pressure of the discharge gas, the operating temperature, etc., and accordingly shows correspondingly large differences among different lamps.

Since it is hardly possible against a reasonable expense to adjust all these parameters in a suitable manner for limiting the drop in burning voltage, and in addition these parameters have to be chosen very differently anyway in dependence on the type of discharge lamp, the burning voltage of certain lamps can drop so strongly that it will lie below a certain minimum voltage of the lamp driver circuit, so that the lamp can no longer be operated at its rated power level, or fails completely or has to be exchanged. This may cause considerable additional expense, which can also be avoided with the method according to the invention and the circuit arrangement according to the invention.

Investigations have shown that the lamp current rises in a lamp operated at a constant power when the electrode distance becomes shorter owing to the accumulation of electrode material at the electrode tips. If the low degree of dependence of the power consumption of the electrode on the length of the electrode tip is disregarded, it may be assumed that the power consumption is proportional to the lamp current and accordingly rises with the length of the electrode tip.

The removal of heat from the electrode tip (in particular by heat conduction along the electrode and by heat radiation) is substantially limited by the relevant electrode shape. The temperature of the electrode tip thus reaches the melting temperature of the electrode material (substantially tungsten) at a given current value. Experiments have shown that practically no electrode growth can be observed anymore after a molten electrode tip has been formed.

In a situation in which the growth of the electrode tip is limited by its molten state, the length of the electrode tip can be influenced or controlled by the width or diameter thereof. For a thin tip, the heat transport along the electrode is less effective than for a thicker tip. This has the result that the frontmost surface of a thin tip reaches the melting temperature already at a smaller length of the electrode tip.

Experiments have shown that the width or diameter d of the electrode tip is dependent on the operating frequency f of the lamp, i.e. approximately in accordance with the equation: $d=c\sqrt{f[Hz]}$, wherein c lies between approximately 2500 and approximately 4000 μm.

Comparatively thin and short electrode tips can thus be achieved with an increased second operating frequency of the lamp, which preferably lies in a range between approximately 400 Hz and approximately 1000 Hz, or which is approximately twice to approximately twenty times the first, normal operating frequency (for example of approximately 50 to approximately 200 Hz), so that the operating voltage cannot drop too strongly because of the limited growth of the electrode tips thus achieved.

There is a risk, however, in particular in the case of UHP lamps and an operating frequency that is too high, that the electrodes are burned back comparatively quickly, whereby lamp life is shortened. To avoid this, the higher operating frequency is only activated when the operating voltage drops below a given, first limit value $U_1$. This first limit value $U_1$ is preferably chosen such that it has a sufficiently great distance of, for example, approximately 10 V from the minimum lamp driver voltage $U_{driver}$ (at which the driver unit can still drive the lamp with its rated power or a desired power), i.e. $U_1=U_{driver}+10$ V.

In a first embodiment of the method according to the invention, therefore, the burning voltage is measured continuously or at given time intervals during a first, normal mode of operation of the lamp with a first standard or normal operating frequency of the lamp current of, for example, approximately 90 Hz (possibly with superimposed pulses for stabilizing the arc discharge), and a comparison is made with the first limit value $U_1$. The moment the burning voltage reaches or undershoots the first limit value $U_1$, a second mode of operation with a second operating frequency of, for example, approximately 500 Hz is activated. A further growth of the electrode tips is limited thereby, and possibly also slowed down or even prevented. When the burning voltage reaches or exceeds the first limit value $U_1$ again, the first mode of operation with the first operating frequency is activated again, so that the negative effect of a possible stronger burning-back of the electrodes is a minimum.

FIG. 1 shows by way of example the gradient of the burning voltage U in volts for an UHP lamp with a rated power of 150 W as a function of time T in minutes, for which a first limit value $U_1$ of the burning voltage of approximately 74 V was laid down. As long as the burning voltage lies above this first limit value $U_1$, the lamp is operated in its first, normal mode of operation with a frequency of the lamp current of approximately 90 Hz and superimposed current pulses (3.5 A, 6%).

When the burning voltage drops to the first limit value $U_1$, the second mode of operation with a frequency of the lamp current of approximately 500 Hz (without current pulses) is activated. As is apparent from the Figure, the burning voltage initially drops further, before gradually rising again up to the first limit value $U_1$. Since the maximum burning voltage drop may differ from case to case, it is to be preferred to lay the first limit value $U_1$ a little higher, for example at approximately 75 to 80 V, in dependence on the power curve of the lamp driver circuit used, as applicable, so as to prevent the burning voltage from dropping below the minimum lamp driver voltage at which the lamp driver circuit can no longer supply the rated power or a desired power to the lamp.

As was explained above, the combination of certain lamp and/or operating parameters may have the result for certain lamps that the burning voltage drops particularly strongly during the first hours of operation. The first embodiment of the method may be supplemented in various manners so as to take account of this possibility and to prevent the burning voltage from dropping below the minimum lamp driver voltage in such a case.

For this purpose, first of all a second limit value $U_2$ of the burning voltage is laid down, for example lying no more than 5 volts above the minimum lamp driver voltage: $U_2=U_{driver}+5$ V.

If a comparison of the burning voltage with the second limit value $U_2$, carried out continuously or at certain time intervals, leads to the conclusion that the burning voltage reaches or undershoots this second limit value, certain operating parameters of the lamp are changed through activation of a third mode of operation such that a portion of the tip of at least one of the electrodes melts back or burns back, whereby the discharge path, i.e. the gap between the electrodes, is lengthened until the burning voltage reaches or exceeds the second limit value again.

In the simplest case, the lamp current or the lamp power is increased for a short period for this purpose. This first alternative, however, is generally not preferred because the lamp driver circuit in this third mode of operation is already operated at the limit of its specification, and it is also comparatively difficult to influence the molten electrode material by means of a change in current.

Instead, a second alternative is preferred in which at least one of the electrodes is melted back without the lamp current having to be increased.

This utilizes the fact that the power consumption of an electrode, in particular of an UHP lamp, is higher in the anode phase than in the cathode phase, with the relevant factor being also dependent on the operating frequency. In the case of DC operation, the power ratio between cathode and anode is approximately 0.6, whereas in AC operation at approximately 100 Hz it holds that: $P_{cathode}<P_{AC}<P_{anode}$.

It is possible to increase the power consumption of the envisaged electrode and to melt off a portion of its tip through an increase in the duration of the anode phase in the third mode of operation as compared with the first mode of operation. There are two possibilities for realizing this second alternative, i.e. first a lamp operation at a very low third operating frequency, and second the use of a DC component applied to the lamp.

The third operating frequency preferably lies in a range between approximately 0.1 and approximately 30 Hz, and particularly preferably at approximately 20 Hz, or is lower than the second operating frequency by a factor of between approximately 2 and at least approximately 1000.

The duration of the third mode of operation generally lies in a range between approximately 0.1 and approximately 100 seconds, in particular at 10 seconds, leading to a very fast rise of the burning voltage in an order of magnitude of several volts.

Figure 2:
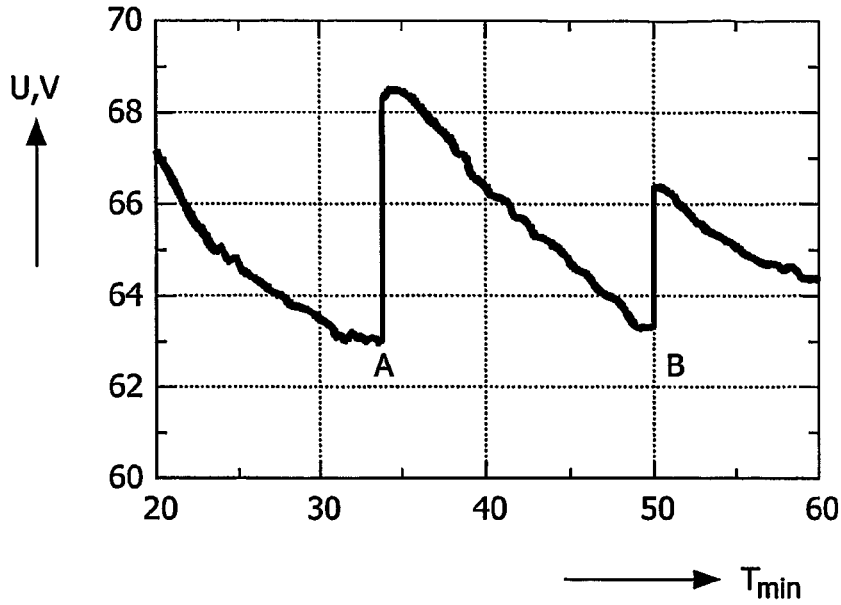
FIG. 2 shows the gradient of the burning voltage during switch-over between a first and a third mode of operation.

FIG. 2 shows the relevant gradient of the burning voltage U in volts as a function of time T in minutes for an UHP lamp of 100 W in the first mode of operation with (curve A) and without (curve B) superimposed current pulses, for which the second limit value $U_2$ of the burning voltage was laid down at approximately 63 V. As is apparent from FIG. 2, the third operating frequency (in the third mode of operation) of approximately 20 Hz is activated for a period of between approximately 1 and approximately 10 seconds upon reaching of this second limit value. The increase in the electrode gap achieved thereby owing to a melting or burning-back of a portion of the electrode tips leads to a considerable rise in the burning voltage.

It should also be taken into account here that the electrode distance can be particularly effectively increased when the electrode tips were previously shaped by means of a high operating frequency, for example in the second mode of operation, because in this case they are comparatively thin and short and can accordingly be melted back more easily.

Given an electrode whose tip is composed of a comparatively wide portion generated by a low frequency (for example approximately 90 Hz with superimposed current pulses) and a comparatively thin (end) portion generated by a higher frequency (for example approximately 500 Hz), moreover, this third mode of operation will substantially only melt back the thin portion of the electrode tip, while the wider electrode portion, which is of particular importance for achieving a high stability of the arc discharge, remains at least substantially unaffected.

Figure 3:
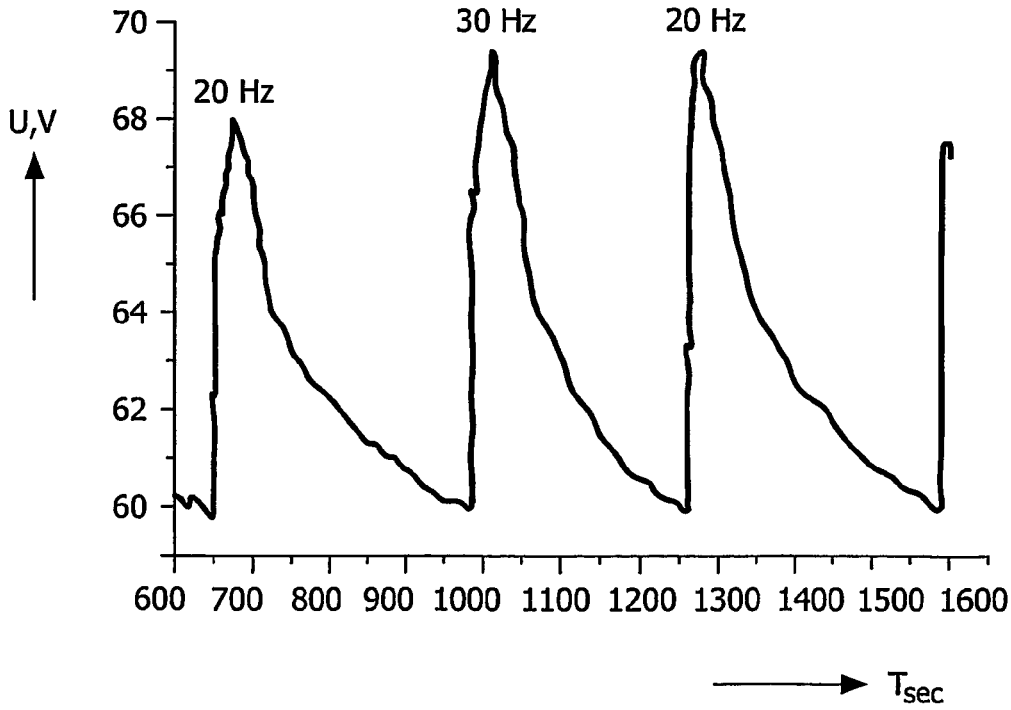
FIG. 3 shows the gradient of the burning voltage during switch-over between a second and a third mode of operation.

FIG. 3 shows the gradient of the burning voltage U in volts as a function of time T in seconds for an UHP lamp of 150 W in this situation, where said thin electrode tips are melted back through activation of the third operating frequency of 20 Hz or 30 Hz without superimposed current pulses when a second limit value $U_2$ of the burning voltage of approximately 60 V is reached.

Figure 4:
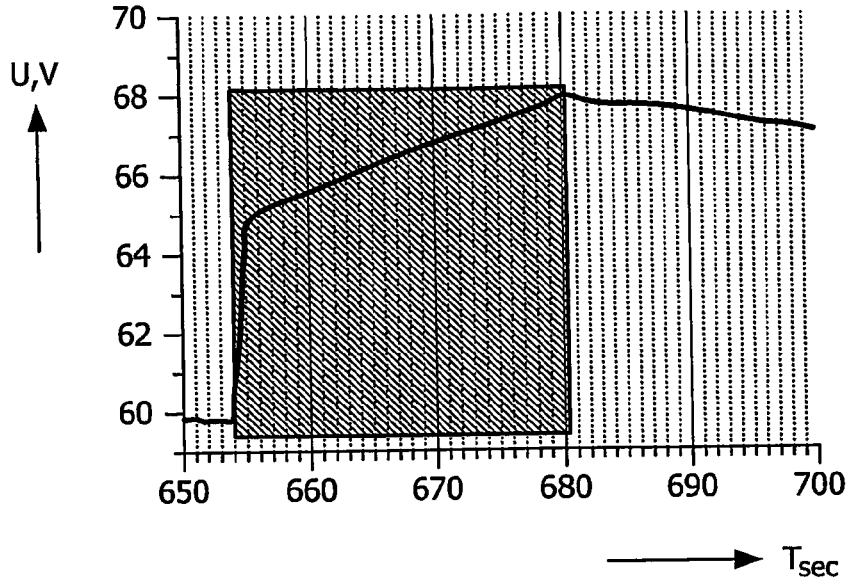
FIG. 4 shows a portion of the gradient of FIG. 3 on an enlarged time scale.

The required duration of the third mode of operation should be specially noted here. FIG. 4 shows the gradient of the burning voltage U in volts during the third mode of operation in seconds on an enlarged time scale. This representation makes it clear that a rise in the burning voltage of approximately 5 V is already achieved approximately one second after the start of the third mode of operation, and the third mode of operation (third operating frequency of 20 Hz) can be ended and the second mode of operation can be resumed after approximately 26 seconds.

As was noted above, the third mode of operation may also be realized through the use of a DC component as an alternative to the third operating frequency.

Said DC component is then preferably first applied to the lamp in one current direction and then in the other current direction, such that the time duration for each may lie between approximately 0.1 and approximately 10 seconds.

In the simplest case, the DC component is generated in that the lamp current commutations taking place in the first, normal mode of operation are suppressed for activating the third mode of operation, or in that the switching cycle between the commutations is changed.

This third mode of operation is thus particularly advantageous for achieving a fast increase in the burning voltage in those cases in which this voltage has reached, or undershoots, a critical low value for the lamp driver (i.e. the suitably preset second limit value $U_2$).

In a particularly preferred method of driving a discharge lamp, the second and the third mode of operation are used in combination as follows.

Given a suitable choice of the first limit value $U_1$, it can be prevented for most lamps in the second mode of operation that the burning voltage drops so far that the specifications of the relevant lamp driver unit are exceeded. This is essentially achieved in that any further growth of the electrode tips is limited, possibly slowed down or even prevented, in the second mode of operation.

It is only in those comparatively few cases in which the burning voltage drops particularly quickly and/or strongly because of certain lamp and/or operating parameters that the third mode of operation is activated for one or several seconds upon reaching of the second limit value $U_2$ so as to raise the burning voltage again above the second, or even above the first limit value, whereupon a switch-over is made again to the second or the first mode of operation, as applicable.

This third mode of operation can be very effectively used also because the second mode of operation (or possibly a corresponding lamp conditioning) renders it possible to generate electrode tips of comparatively small diameters, which can be melted back or eliminated comparatively easily and effectively with the third mode of operation, while the adjoining electrode portion of greater diameter remains at least substantially unchanged.

Figure 5:
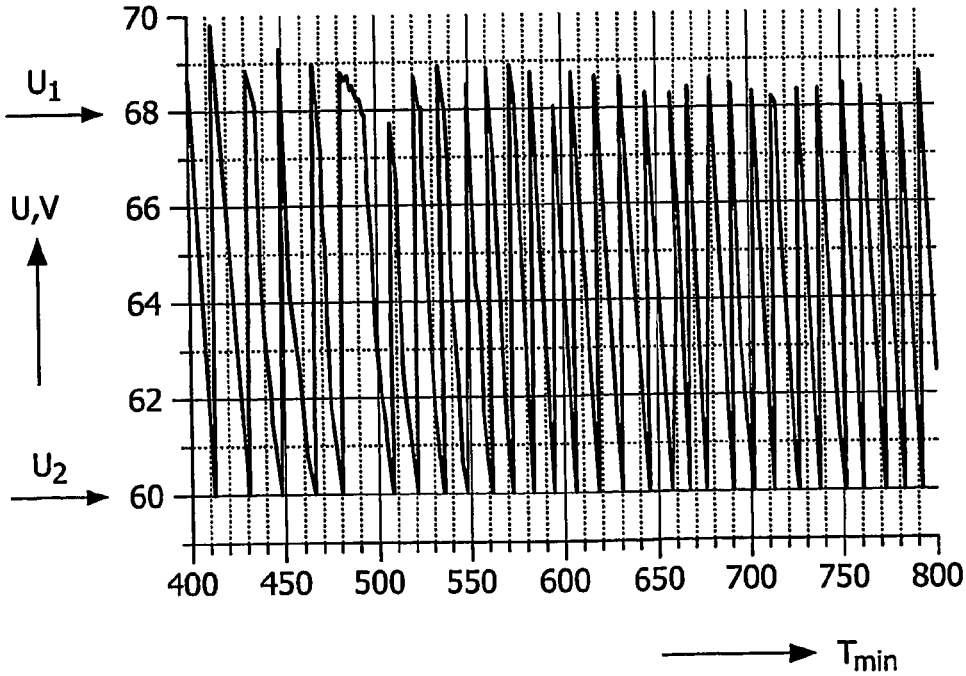
FIG. 5 shows a first gradient of the burning voltage during switch-over between a first, a second, and a third mode of operation.

FIG. 5 shows by way of example the gradient of the burning voltage U in volts as a function of time T in minutes for such an UHP lamp with a rated power of 150 W, where the first limit value $U_1$ was laid down at approximately 68 V and the second limit value $U_2$ at approximately 60 V. The comparatively steep rise of the burning voltage after activation of the third mode of operation during approximately 10 seconds (20 Hz) upon reaching of the second limit value $U_2$ is particularly apparent from this Figure. As long as the burning voltage is higher than the first limit value $U_1$ the first mode of operation is active, whereas the second mode of operation is active at a burning voltage in the range between the first and the second limit value.

Figure 6:
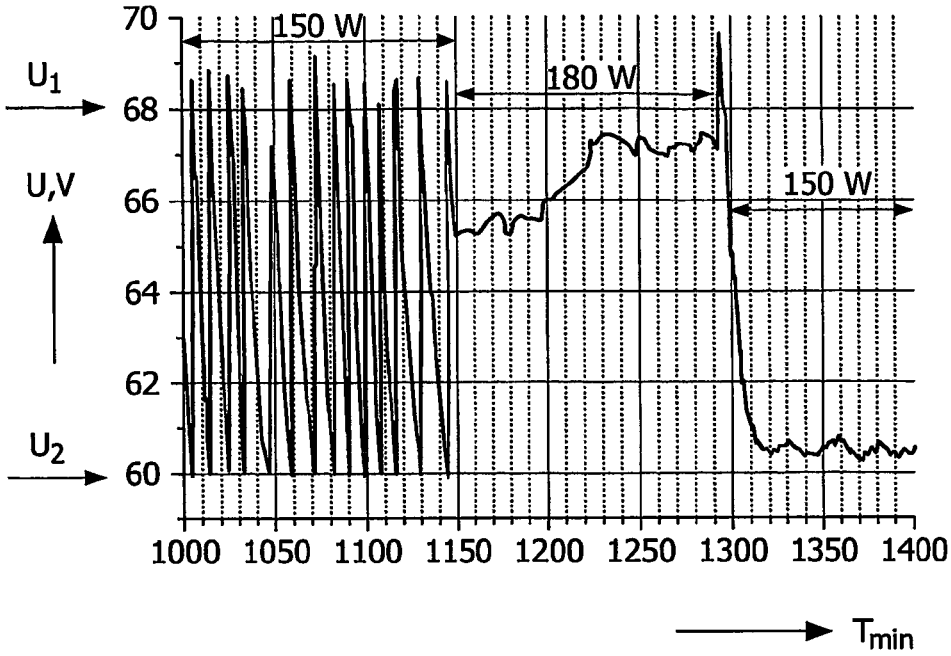
FIG. 6 shows a second gradient of the burning voltage during switch-over between a first, a second, and a third mode of operation.

FIG. 6 shows a gradient of the burning voltage as a function of time T for the same lamp as in FIG. 5. It is apparent from this Figure that the burning voltage no longer drop, but rises gradually at a lamp operation with an increased power of 180 W as opposed to 150 W in FIG. 5 in the second mode of operation. This is essentially based on the fact that in this case the electrode growth at the second operating frequency of 500 Hz has at least substantially been arrested. The situation shown in FIG. 5 establishes itself substantially again when the lamp is operated with 150 W again, i.e. is dimmed.

To avoid a frequent switch-over between the first and the second mode of operation, a hysteresis is preferably set. This may be achieved, for example, in that the second mode of operation is indeed activated when the burning voltage drops to the first limit value $U_1$, but that a return to the first mode of operation is not made until the burning voltage lies approximately 2 V above the first limit value $U_1$ again.

A too frequent switching-over between the second and the third mode of operation may be prevented in that the first limit value $U_1$ is chosen to be comparatively high (as in FIG. 1, $U_1$=74 V) and/or the second limit value $U_2$ is chosen to be comparatively low.

Figure 7:
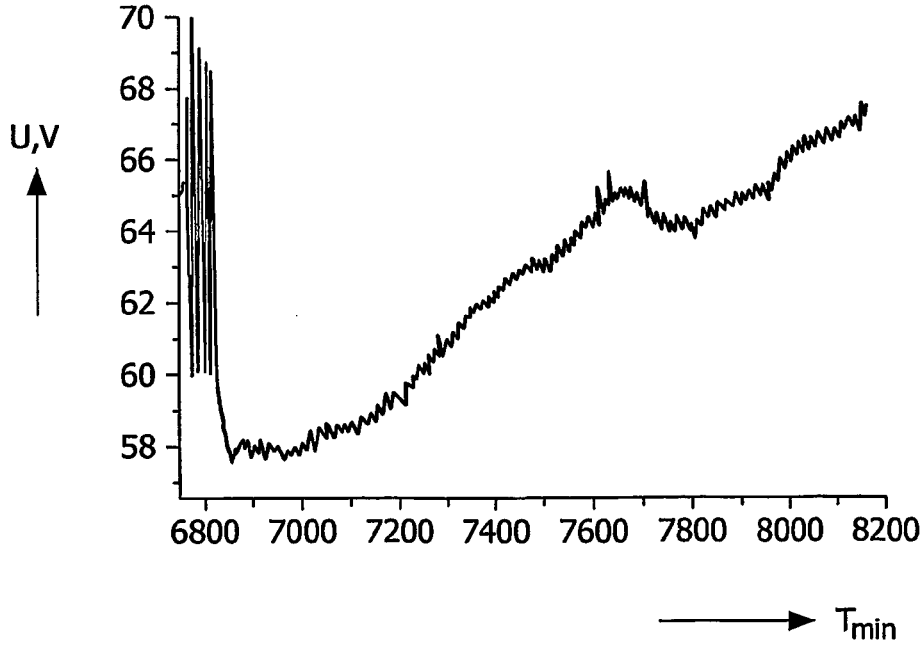
FIG. 7 shows a third gradient of the burning voltage during switch-over between a first, a second, and a third mode of operation.

For example, a change, i.e. lowering of the second limit value from $U_2$=60 V down to $U_2$=50 V leads to a burning voltage gradient as shown in FIG. 7.

It is to be noted, in particular in view of the use of the method according to the invention or the circuit arrangement according to the invention for operating a high-pressure gas discharge lamp for a lighting unit in a projection system, that the electrodes always have a molten electrode tip in all three modes of operation, so that an unstable arc discharge, or an arc leap can be prevented.

In the first mode of operation, this is substantially achieved by means of a known pulse shape of the lamp current or of the current pulses superimposed thereon. In the second mode of operation, the thin tip growing on the electrode end always has a molten front structure, also if the lamp current comprises no current pulses. In the third mode of operation, the electrode tip to be melted back is necessarily in the molten state.

Figure 8:
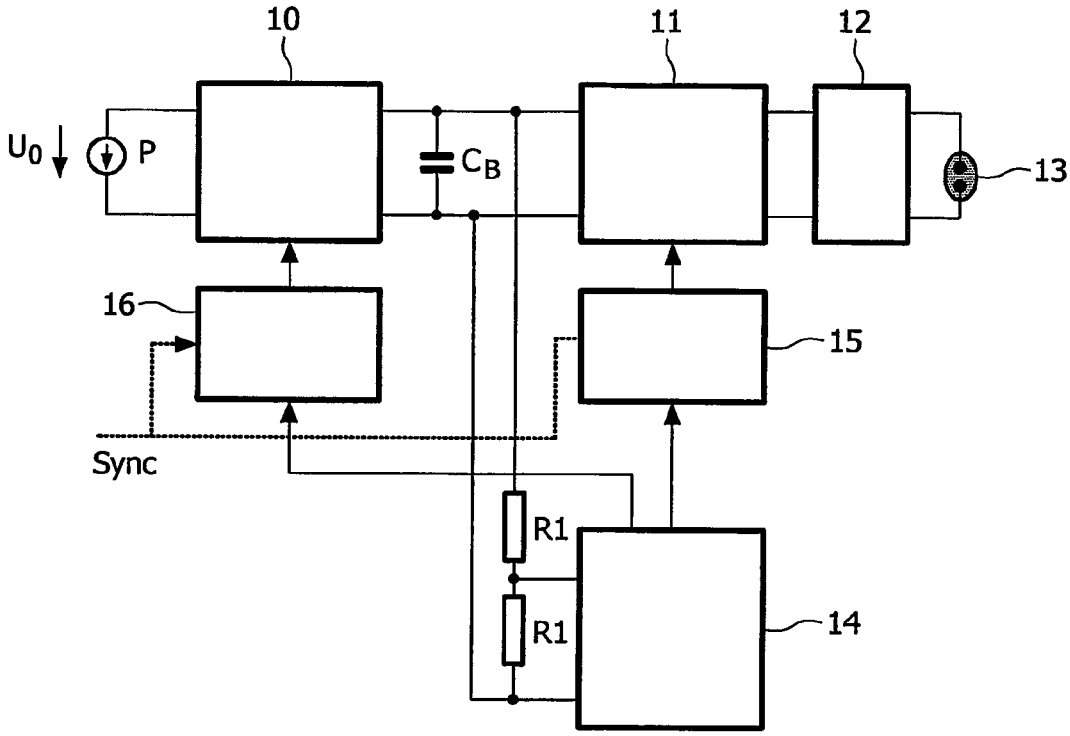
FIG. 8 is a block diagram of a circuit arrangement for implementing the method.

FIG. 8 shows an embodiment of a circuit arrangement for implementing the method according to the invention.

The circuit comprises a power source with which a supply voltage $U_0$ of, for example, 380 V DC is made available, supplying a downconverter 10. The output of the converter 10 is connected via a buffer capacitor $C_B$ to a commutator stage 11, which in its turn supplies an ignition stage 12 by means of which the connected lamp 13 is ignited and operated.

Figure 10:
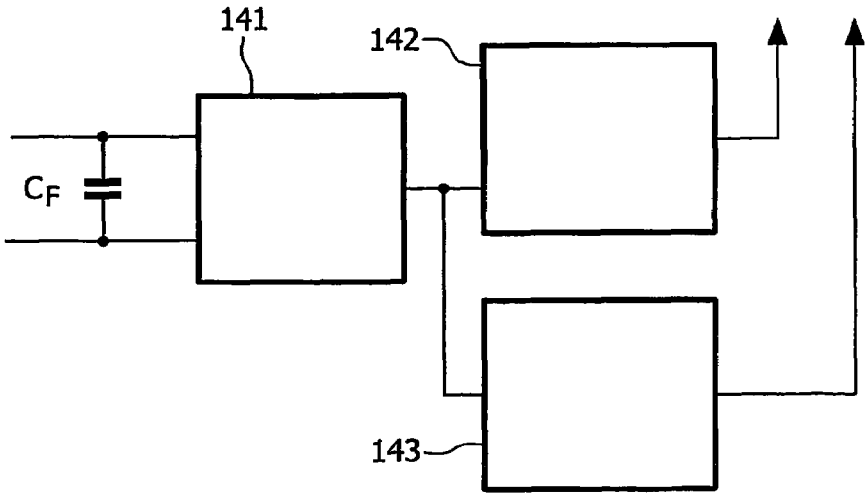
FIG. 10 shows a second component of the circuit arrangement of FIG. 8 in detail.

The voltage applied to the buffer capacitor $C_B$ is additionally fed via a voltage divider R1/R1 to a comparator 14 for monitoring the burning voltage and for comparing the burning voltage with said limit values (and further functions of FIG. 10). A first output signal of the comparator 14 is supplied to a generator 15 for generating the operating frequencies of the lamp current, which current in its turn is applied to the commutator stage 11. A second output signal of the comparator 14 is applied to a generator 16 for generating the current waveform for the downconverter 10.

Figure 9:
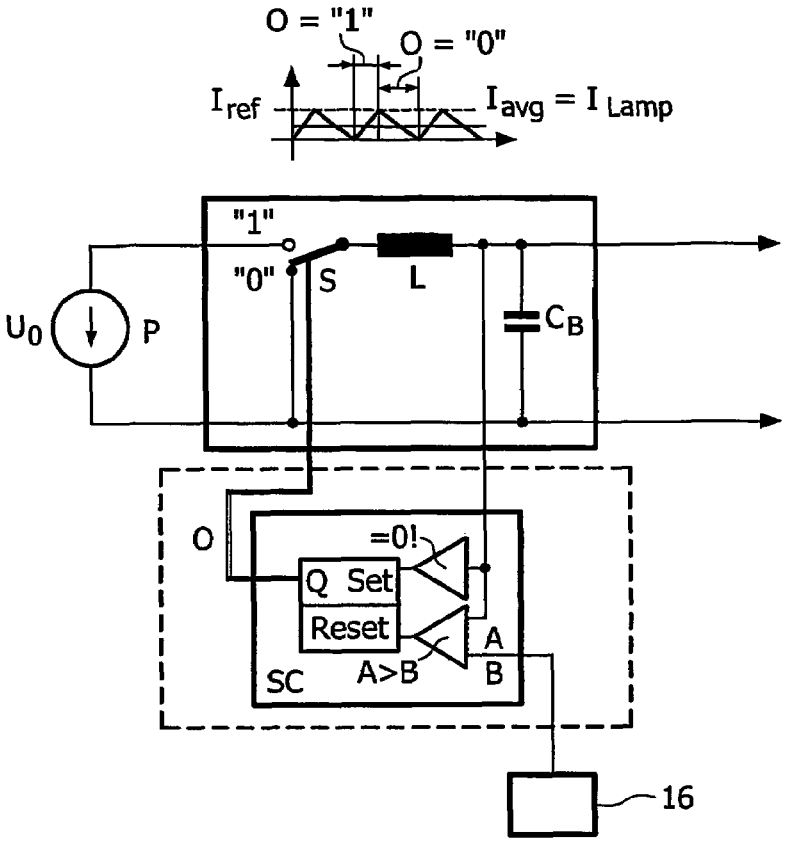
FIG. 9 shows a first component of the circuit arrangement of FIG. 8 in detail.

FIG. 9 shows the downconverter 10 with the power source P and the buffer capacitor $C_B$ in detail.

The downconverter 10 substantially comprises a series-connected coil (inductance) L which is connected via a switch S to the power source P, such that it can be separated from the latter and be connected in parallel to the buffer capacitor $C_B$.

Furthermore, a switching member SC is provided, to whose one input a current signal is applied, for example inductively obtained from the coil L, and to whose other input the output signal of the waveform generator 16 is applied.

The output signal of the switching member SC (for example a flip-flop) switches the switch S such that the substantially sawtooth current gradient as shown is achieved by the inductance L.

FIG. 10 is a detailed block diagram of the comparator 14. The voltage across the resistor R1 (FIG. 8), which is proportional to the instantaneous burning voltage, is supplied to an analog/digital converter 141 via a filter capacitor $C_F$.

The digitized voltage is then supplied to a pulse generator stage 142 which generates the current pulses which are to be superimposed on the lamp current in the first mode of operation (i.e. when the voltage is above the first limit value) and which contribute to a stabilization of the arc discharge. These current pulses are supplied to the waveform generator 16 for the lamp current so as to generate the corresponding lamp current through the downconverter 10.

The digitized voltage is furthermore supplied to a comparison and switching stage 143, which compares the voltage with the limit values so as to supply a suitable switching signal to the generator 15 for generating the operating frequencies of the lamp current.

As was explained above, the first operating frequency is activated when the burning voltage is higher than or equal to the first limit value $U_1$. When the burning voltage lies between the first and the second limit values $U_1$, $U_2$, the second operating frequency is switched on, and the third operating frequency is activated in cases in which the burning voltage reaches or undershoots the second limit value.

The following aspects should be heeded as regards the choice of operating frequencies when the discharge lamps are used in lighting units for projection systems, which react sensitively to light fluctuations during the lamp current cycle (such as, for example, DLP and LCOS systems):

a) To avoid light fluctuations, artifacts, and other image disturbances, the first operating frequency in the first mode of operation should be synchronized with the image frequency or an integer multiple or fraction thereof.

The second operating frequency is derived from the first operating frequency so as not to generate any disturbances also in the second mode of operation. To this end, the control unit of the lamp driver first determines the synchronization frequency and then divides the desired second operating frequency by the synchronization frequency. This quotient is rounded to the next higher integer and is then multiplied by the synchronization frequency again. The resulting frequency is used as the second operating frequency.

The third (low) operating frequency may be calculated in a similar manner, but here its synchronization is not so critical because of the usually very short duration of the third mode of operation.

b) A further measure for avoiding image disturbances is that the display system should be adapted to the gradient of the lamp current. For this purpose, the relative value of the pulse current may be transmitted to the display system and corrected in all modes of operation, or the display system is continuously corrected for a given pulse current.

It should additionally be noted that the third operating frequency may be substantially equal to the first operating frequency in certain lamps.

Furthermore, the method according to the invention is preferably not activated until after a warming-up phase of the lamp, i.e. in general after approximately one to two minutes after its switching-on and reaching a substantially stationary operating temperature.

Finally, the circuit arrangement for implementing the method according to the invention preferably comprises a microprocessor or microcontroller with a software program by means of which the process steps explained above are carried out or controlled.

The invention claimed is:

1. A method of operating a discharge lamp in:

a first mode of operation having a first operating frequency, which is activated when a burning voltage of the lamp is at least as high as a first limit value, a second mode of operation with a second operating frequency that is higher than the first operating frequency, which is activated when the burning voltage of the lamp is not more than the first limit value, and a third mode of operation which is activated when the burning voltage of the lamp is not more than a second limit value that is lower than the first limit value, and in which third mode of operation a discharge path between electrodes of the lamp is lengthened by a change in at least one operating parameter of the lamp until the burning voltage is at least as high as the second limit value.

2. The method of claim 1, wherein the first operating frequency lies between approximately 50 and 200 Hz.

3. The method of claim 1, wherein the lamp current is superimposed with current pulses in the first mode of operation.

4. The method of claim 1, wherein the second operating frequency is higher than the first operating frequency by a factor between approximately 2 and 20.

5. The method of claim 1, wherein the second operating frequency has a value of between approximately 300 and 1500 Hz.

6. The method of claim 1, wherein the first limit value lies at a voltage that is approximately 10 V higher than a minimum voltage of a lamp driver unit that can still drive the lamp with its rated power or a desired power.

7. The method of claim 1, wherein the first limit value has a hysteresis.

8. The method of claim 1, wherein the at least one operating parameter includes a third operating frequency that is lower than the second operating frequency by a factor of between approximately 2 and 1000.

9. The method of claim 8, wherein at least one of the second operating frequency and third operating frequency is synchronized with an image frequency of a display system.

10. The method of claim 1, wherein the at least one operating parameter includes a DC component that is applied to the lamp.

11. The method of claim 1, wherein the second limit value lies at a level that is approximately 5 V higher than a minimum voltage of a lamp driver unit that can still drive the lamp with its rated power or a desired power.

12. The method of claim 1, wherein the second operating frequency is synchronized with an image frequency of a display system.

13. The method of claim 1, wherein the discharge path is lengthened by the change in the at least one operating parameter until the burning voltage is at least as high as the first limit value.

14. A circuit arrangement comprising:

a controller that is configured to operate a discharge lamp in:

a first mode of operation having a first operating frequency, which is activated when a burning voltage of the lamp is at least as high as a first limit value, a second mode of operation with a second operating frequency that is higher than the first operating frequency, which is activated when the burning voltage of the lamp is not more than the first limit value, and a third mode of operation which is activated when the burning voltage of the lamp is not more than a second limit value that is lower than the first limit value, and in which third mode of operation a discharge path between electrodes of the lamp is lengthened by a change in at least one operating parameter of the lamp until the burning voltage is at least as high as the second limit value a comparator for comparing the burning voltage with the first limit value, and a generator for generating the first and second operating frequencies of the lamp current in dependence on an output signal of the comparator.

15. A lighting unit that includes a high-pressure gas discharge lamp and a circuit arrangement as claimed in claim 14.

16. A projection system with a projection display and a lighting unit as claimed in claim 15.

* * * * *